US007736089B2

(12) United States Patent
Brais

(10) Patent No.: US 7,736,089 B2
(45) Date of Patent: Jun. 15, 2010

(54) SYSTEM AND METHOD FOR PREVENTION OF BEACH EROSION

(76) Inventor: David Brais, 85 Whiting St., Cranston, RI (US) 02920

( * ) Notice: Subject to any disclaimer, the term of this patent is extended or adjusted under 35 U.S.C. 154(b) by 380 days.

(21) Appl. No.: 11/703,561

(22) Filed: Feb. 7, 2007

(65) Prior Publication Data

US 2008/0187398 A1 Aug. 7, 2008

(51) Int. Cl.
*E02B 3/04* (2006.01)

(52) U.S. Cl. ..... 405/28; 405/25; 405/30; 405/35

(58) Field of Classification Search ..... 405/15, 405/21, 25, 28, 30, 35; 256/12.5
See application file for complete search history.

(56) References Cited

U.S. PATENT DOCUMENTS 5,888,020 A * 3/1999 Brais et al. ..... 405/28

* cited by examiner

*Primary Examiner*—Frederick L Lagman
(74) *Attorney, Agent, or Firm*—Lambert and Associates; Gary E. Lambert

(57) ABSTRACT

A system and method for prevention of erosion utilizing a sub-tidal platform designed to be lodged at a beachhead. The sub-tidal platform will be placed under water and will contain at least one or a plurality of main trusses exhibiting a curvilinear convex shape and containing a plurality of gates and at least one or a plurality of intermittent trusses exhibiting a curvilinear convex shape and containing a plurality of gates which, when in their closed position, decelerate material entrained with liquid and allow for deposit of said material in the spaces formed by the trusses.

27 Claims, 10 Drawing Sheets

SYSTEM AND METHOD FOR PREVENTION OF BEACH EROSION

BACKGROUND OF THE INVENTION

1. Field of Invention

The present invention relates generally to the field of beachhead preservation and particularly to methods and devices designed for prevention of beach erosion.

2. Related Art

Erosion of beaches due to waves displacing sediment has been an enduring problem, threatening coastal communities throughout the world. Apparatuses for preventing erosion of beaches, the bottoms and/or banks of rivers or streams, and/or for producing material deposits under water, are well-known in the art. Various techniques to prevent erosion are known in the art, as illustrated by the myriad of invention discussed herein. U.S. Pat. No. 5,888,020 details an apparatus including only a single truss system with gates, but fails to encompass the novel features of the instant invention, including multiple trusses.

U.S. Pat. No. 5,011,327 details an apparatus utilizing vertically stacked tiers of halved tires in order to reduce erosion as the tires allow water to pass through while causing solid matter present in the water to become trapped and build up over time. One of the disadvantages of this apparatus is the fact that it requires an entire array of tires for the trapping effect to work and this makes the apparatus more cumbersome. U.S. Pat. No. 5,795,099 discloses an apparatus that uses mesh flaps that will open when water is flowing toward a beach but will close when flowing the other direction. The mesh allows water to flow through but the holes in the mesh are small enough that sand cannot get through. The same disadvantage exists with this apparatus because it is also cumbersome as several mesh flaps connected together are the only way for the apparatus to work effectively.

U.S. Pat. No. 5,876,151 reveals an apparatus and method using a system consisting of rungs and viscous drag elements to trap sediment. Once again, this apparatus is cumbersome because it involves an entire system to be effective. U.S. Pat. No. 5,975,796 details a concrete mat that has non-abrasive surfaces for trapping sand. The disadvantage with this is that concrete is heavy and may cause damage to the beach that is different in nature from erosion.

U.S. Pat. No. 2,655,790 to Daley discloses a vertical permeable barrier wall formed in sections and mounted on a horizontal platform. The wall includes a series of flexible vanes fixed at their lower ends on horizontal axes and free to flex in either direction in response to wave or current flow, so that water flows through the wall in both directions upwardly to reduce the water's velocity, causing it to drop sediment at the base of the wall on both sides thereof.

U.S. Pat. No. 3,011,316 to Wilson discloses a breakwater having a pair of spaced-apart fences each with a plurality vanes, hingedly connected between posts so that they extend along horizontal axes. The purpose of Wilson's breakwater is to dissipate waves along the shores of bodies of water where the waves have a normal tendency to wash away the beach. The vanes are provided for dissipating waves traveling towards the beach.

U.S. Pat. No. 3,214,916 to Martin discloses a vertical wall assembly with gates hinged at their upper ends on horizontal axes on a beach side of the wall. The gates open toward the beach in response to incoming waves or current, and close in response to outgoing waves or current, to cause deposition of sediment between the wall and the beach. The wall is mounted on embedded posts and each gate carries a pivoted locking bar which embeds in accumulated deposits as they build up adjacent the bottom of the gate, thereby preventing the gate from thereafter opening in response to incoming waves or current and washing away the accumulated deposits.

Disadvantages of the systems described herein include expense in construction, structural failure due to the stress created by flow of water over time and starvation of sand from their downward drive, thereby negatively impacting the environmental sanctity of the marine life between the systems and the beaches, which they protect. Other objects, features and advantages of the invention shall become apparent as the description thereof proceeds when considered in connection with the accompanying illustrative drawings.

SUMMARY OF THE INVENTION

The instant invention, as illustrated herein, is clearly not anticipated, rendered obvious, or even present in any of the prior art mechanisms, either alone or in any combination thereof. This invention relates generally to apparatuses and constructions used to accumulate material deposits through passage and return passage of fluid flow, and more particularly to a beach erosion control system disposed to create said accumulation via a placement of a sub-tidal platform positioned in beachheads of varying configuration. The instant invention, as illustrated herein, is clearly not anticipated, rendered obvious, or even present in any of the prior art mechanisms, either alone or in any combination thereof.

It is an object of the instant invention to provide an improved sub-tidal platform, which exhibits multi-layered truss systems including at least one intermittent truss and at least one main truss system.

It is an object of the instant invention to provide an improved sub-tidal platform, which exhibits differing sizes of gates of a substantially curvilinear shape convex shaped integral to the intermittent truss system and the main truss system, in order to decelerate particles entrained in water while allowing the water to first enter into the truss structures.

It is an object of the instant invention to provide ribbed surfaces on the working portions of the gates, in order to further decelerate particles entrained in water.

It is an object of the instant invention to provide an improved sub-tidal platform, which exhibits mechanisms such as scoop protrusions embedded or affixed to the working areas of the truss walls in order to further decelerate particles entrained in water.

It is an object of the instant invention to provide an improved sub-tidal platform, disposed to work in tandem with other identical units in order to constitute a system of inter-working units.

It is an object of the present invention to provide a method of erosion protection, prevention and reconstruction of a coast line, thereby incurring life cycle cost savings.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Accordingly, among the several objects of the present invention are the provision of a sub-tidal platform which is capable of managing and protecting the erosion of a beach in front of which it is placed by causing the natural, slow buildup of material between the sub-tidal platform and the beach and the immediate anchoring of a replenished beach; the provision of such a sub-tidal platform which is fabricated from light-weight materials so as to make its implementation easy; the provision of such a sub-tidal platform which is further fabricated from non-corroding materials which extend the life thereof; the provision of such a sub-tidal platform which, over an extended period of time, actually increases the amount of deposit material forming the beach; the provision of such a sub-tidal platform which does not immediately (and negatively) impact the ecology of the beach thereby harming marine life; the provision of such a sub-tidal platform ("STP" or "STP array") or which can easily be removed if necessary; and the provision of such a sub-tidal platform which is relatively simple in construction, cost-efficient to manufacture, and easy to assemble.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENTS

The instant invention is directed to a sub-tidal platform disposed at varying configurations of beachhead. The instant sub-tidal platform provides a method of erosion protection, prevention and reconstruction of a coast line, thereby incurring life cycle cost savings. The invention further protects and prevents against erosion by utilizing an apparatus or a series of apparatuses positioned at a beach head to allow for accumulation of sand, and utilization of multiple platforms enhances said accumulation.

Figure 1:
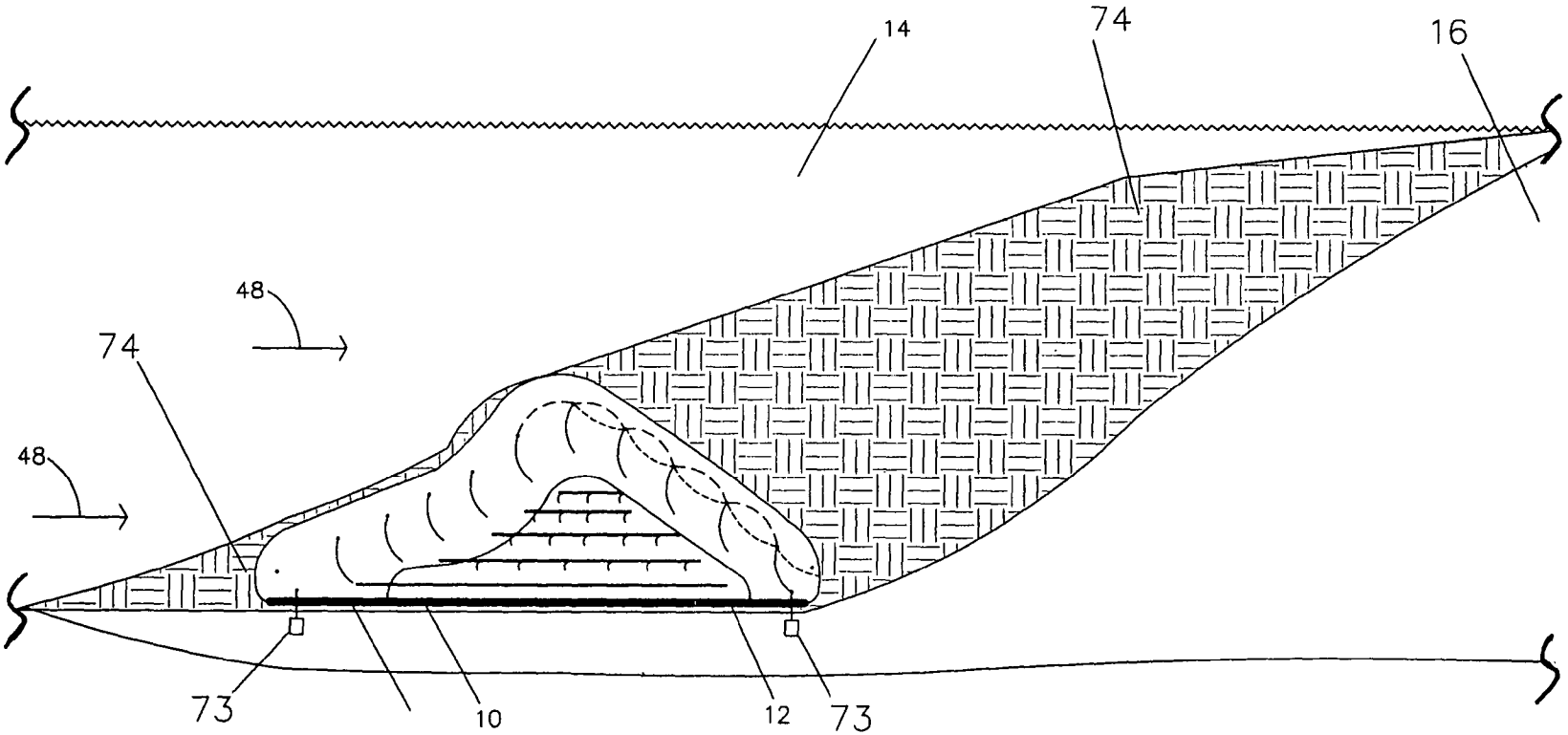
FIG. 1 is a side elevational view of a sub-tidal platform of the present invention positioned at a beachhead, beneath the oncoming water.
Figure 2:
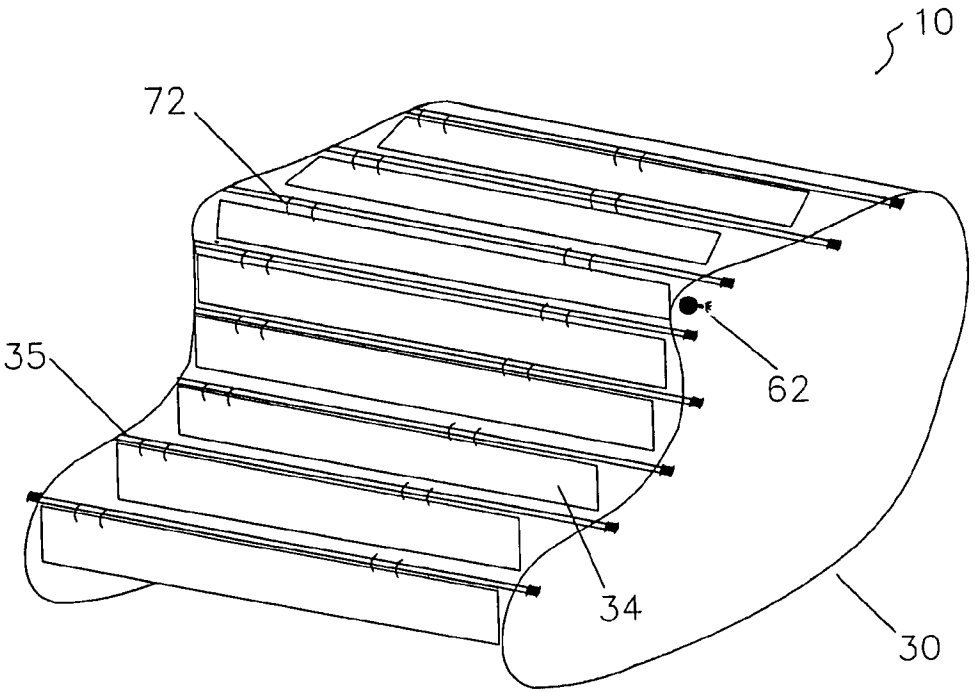
FIG. 2 is a perspective view of the sub-tidal platform illustrated in FIG. 1.
Figure 3:
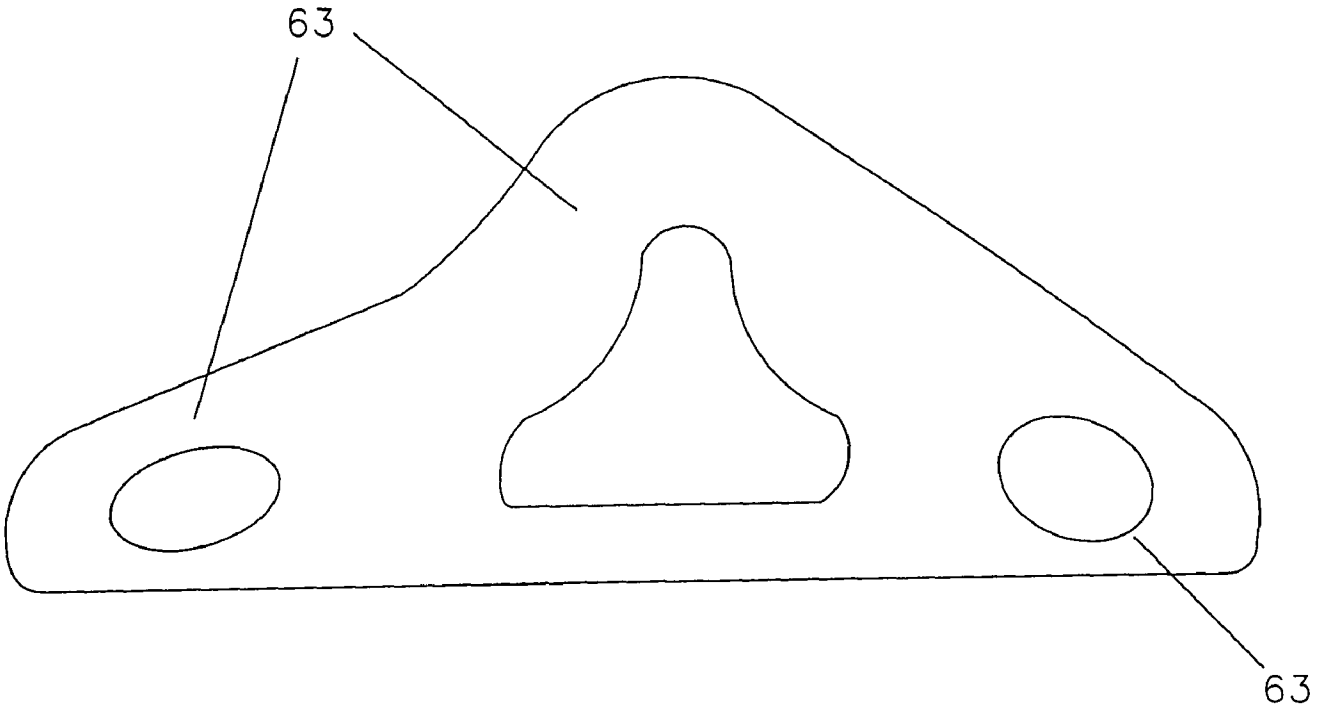
FIG. 3 is a side elevational view of the instant invention illustrating the cutaway areas in the sides of the main truss thereof.

Referring now to the drawings, and more particularly to FIG. 1, there is generally indicated at 10 a sub-tidal platform of the present invention. As illustrated in FIG. 1, the platform 10 is being used as a beach erosion control system which is adapted to be positioned on a bottom 12 of a body of water 14 at beachhead 16 to be protected or restored. The platform 10 is designed so that after a period of time, material is deposited within the platform so that the contour of the bottom 12 of the body of water 14 is raised, thus preventing erosion of the bottom and subsequently the beach 16. It should be understood that depending upon the length of the beach 16 to be protected, any number of platforms 10 can be employed offshore in front of the beach. Moreover, the platforms 10 can be strategically placed either in-line, or at angles with respect to one another for more effectively protecting the beach 16.

Referring to FIGS. 2-8, the instant invention exhibits a sub-tidal anti-erosion platform 10, disposed to be submergably positioned at a beach head, and composed of a support structure comprising at least one or a plurality of main trusses 30 exhibiting a curvilinear convex shape and when more than one are present, connected by a slightly sloping sediment control plate 40. Each main truss contains two vertically disposed side walls 32. The construction of the main truss comprises a series of scoop protrusions 61 deposed for trapping sand and additionally a plurality of main truss large gates 34 comprising a convex shape, the arc of which faces 180 degrees from the incoming flow of water 48.

The construction of the main truss includes a plurality of horizontally disposed interconnecting members 35, which extend between the side walls 32 and allow for mounting of the main truss large gates 34. Each interconnecting member 35 extends through aligned openings (not shown) formed in the side walls 32. These openings are sized to receive the interconnecting members 35 with small tolerance, whereupon the interconnecting members can be permanently attached to the side walls 32 by any suitable means. End caps 36 are provided at the outer ends of each interconnecting member 35 for securing the main truss together. Each end cap 36 has a circumferential flange 38 which engages its respective side wall 32, as known in the art. As shown, each interconnecting member 35 is positioned along the sloping surface of the side walls 32 so that they form a step-like arrangement.

Each interconnecting member 35, between adjacent side walls 32, receives a gate, each generally indicated at 40, which is pivotally connected to the interconnecting member 35 of the support structure 18 for controlling the fluid flow through the space between the side walls 32. The support structure 18 is best defined as main truss in combination with the intermittent trusses. The main truss large gates 34 and intermittent truss small gates 51 are arranged in rows and columns, each gate being movable between an open position during the flow of incoming fluid and a closed position when the outgoing fluid flows in the opposite direction. The arrangement is such that when the gates 34, 51 are in their closed position, they form a sloping wall which substantially blocks the flow of fluid through the spaces between the side walls and material entrained with liquid, such as sand, in the space formed by the side walls and the sloped wall created by the closed main truss large gates upper rows of the intermittent truss small gates.

Figure 4:
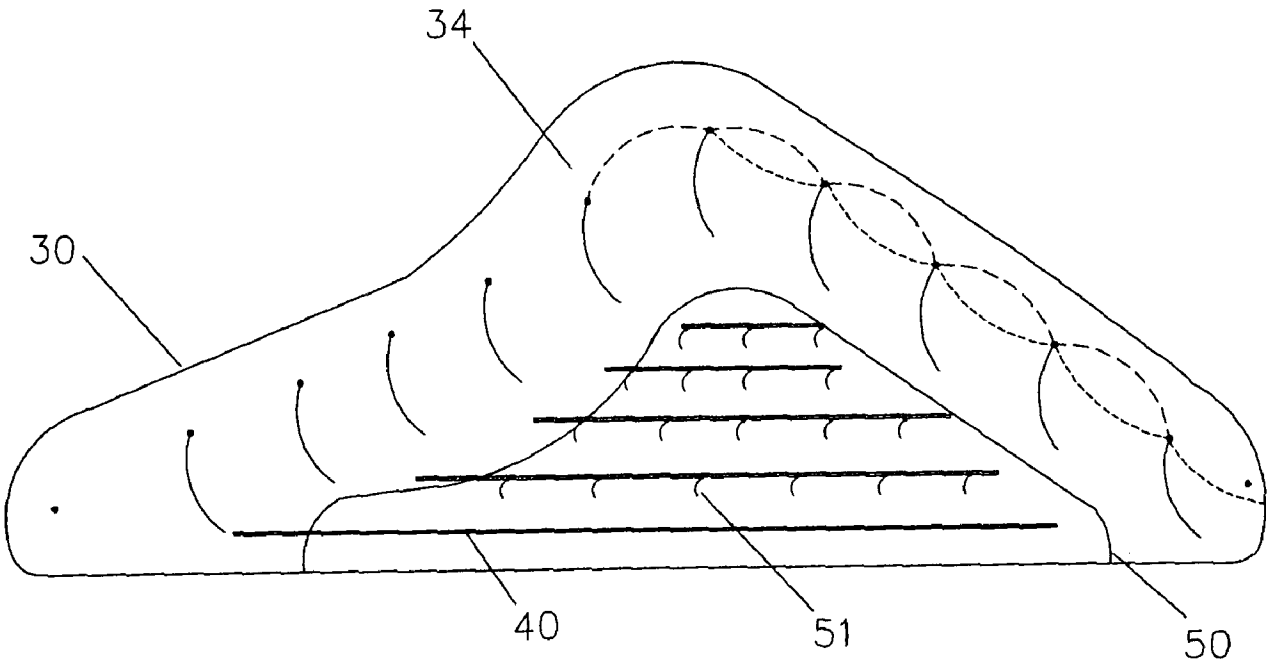
FIG. 4 is a side cross sectional view of the instant invention illustrating the main truss and the larger gates thereof and the intermittent truss and the small gates thereof.
Figure 5:
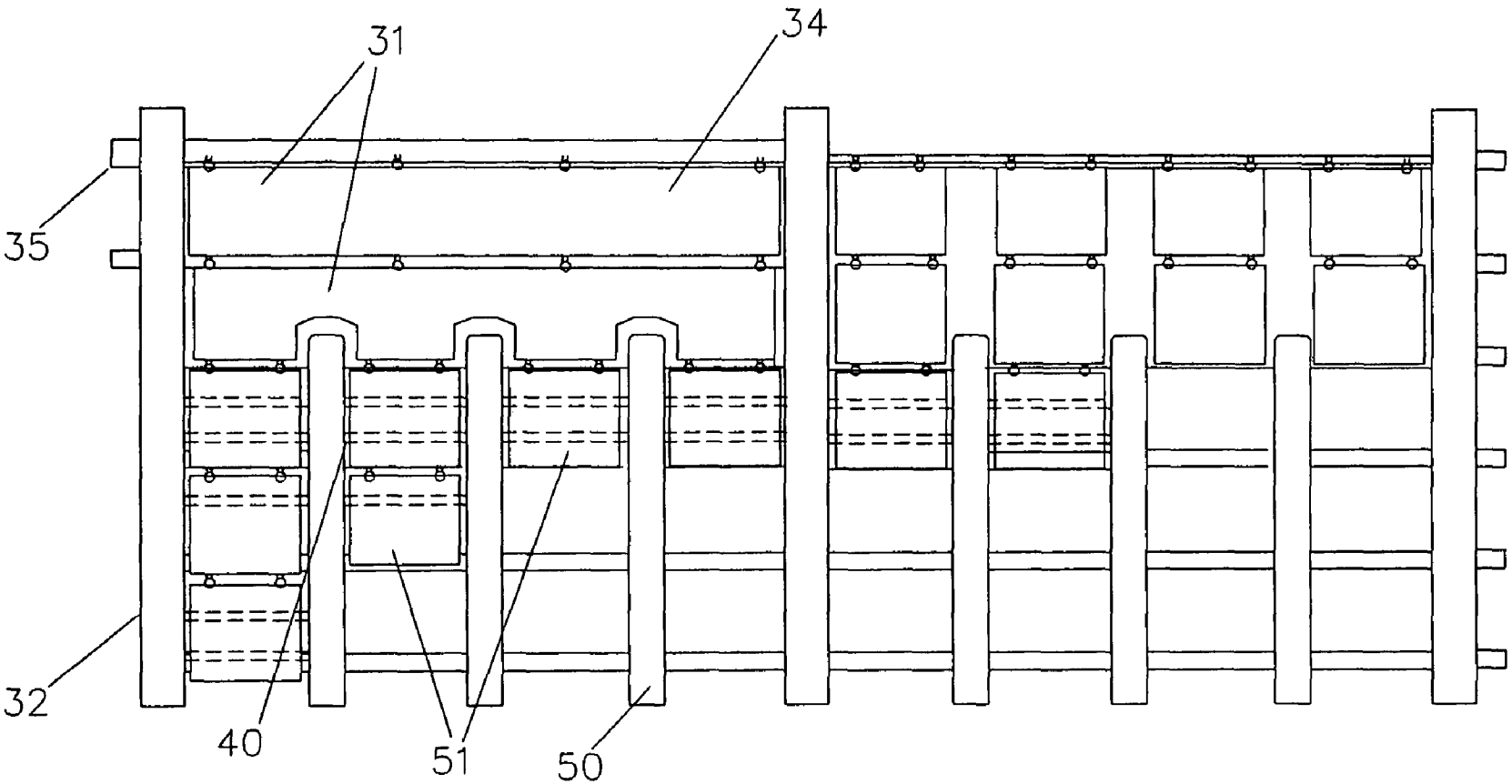
FIG. 5 is a front cross sectional view of the instant invention illustrating the main truss and the large gates thereof and the intermittent truss and the small gates thereof.
Figure 6:
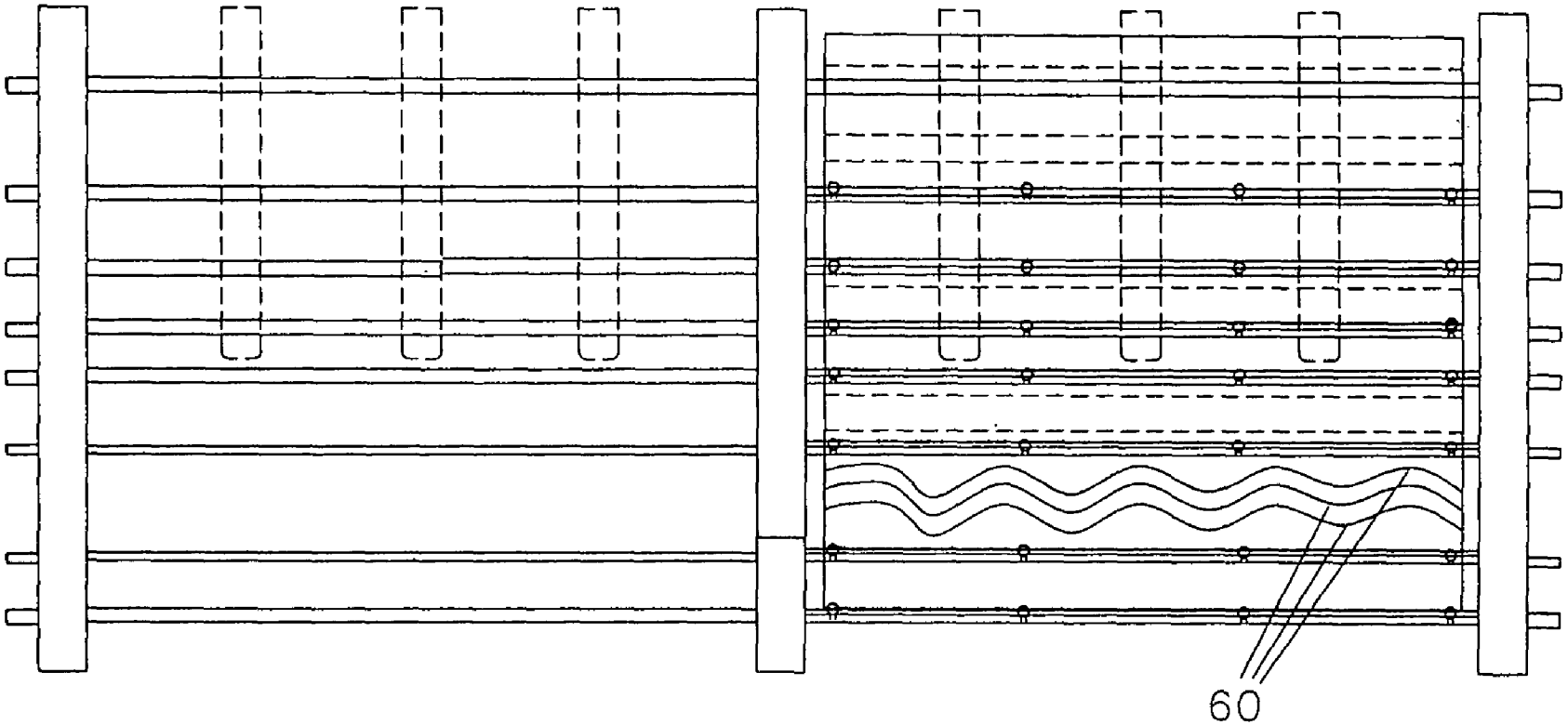
FIG. 6 is a rear view of the instant invention illustrating the rear portion of the main truss and the rearward large gates thereof.
Figure 7C:
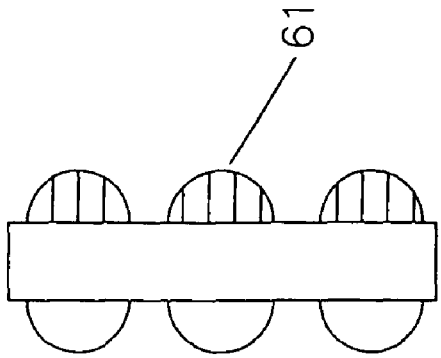
FIG. 7*a*- 7*c* are differing views of a portion of one of the walls of the main truss illustrating the scoop protrusions.
Figure 7B:
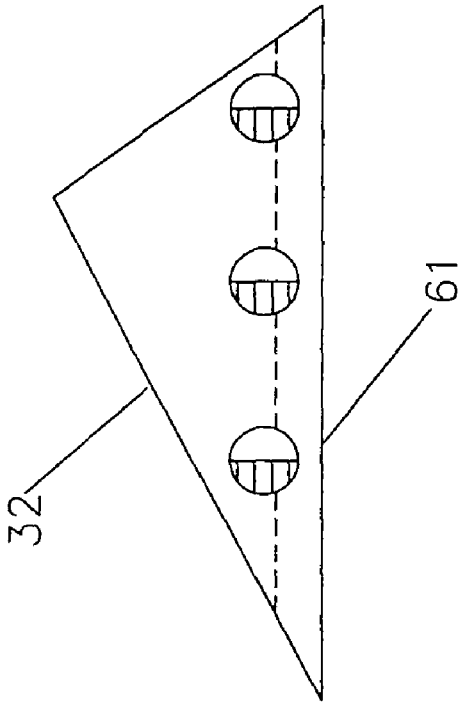
Figure 7A:
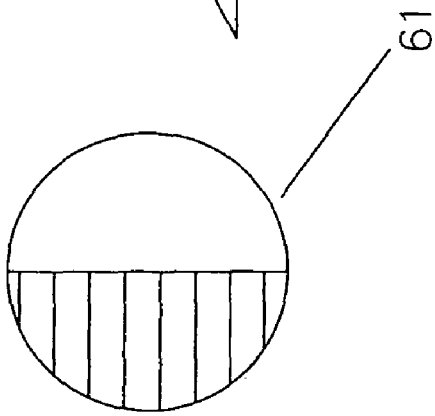
Figure 8B:
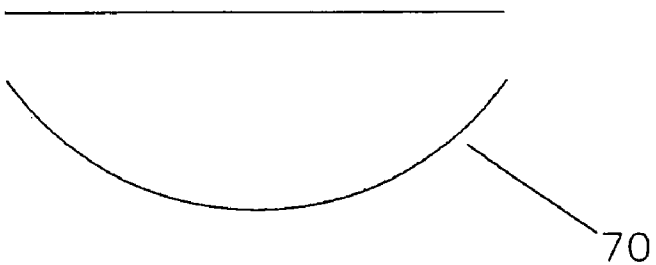
FIG. 8*a*- 8*c* illustrate overhead views of the possible configurations for optimal spatial deployment of multiple sub-tidal platforms in arcuate arrays.
Figure 8C:
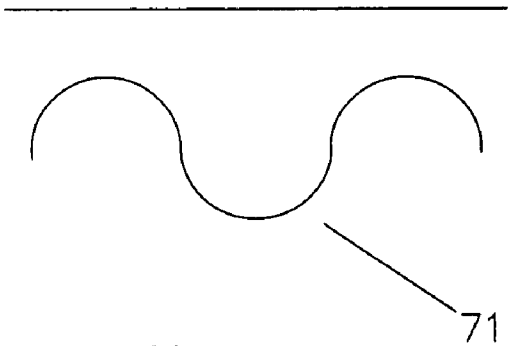
Figure 8A:
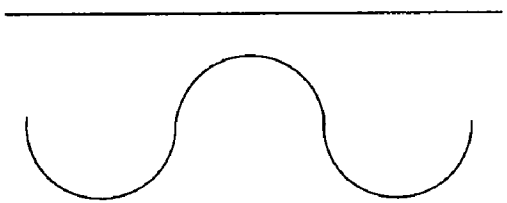

FIG. 4 illustrates the side of the platform 10 and illustrates the swing of the gates 34, 51 using phantom lines. Each main gate 34 has a pair of openings formed along their upper edge margins, each opening receiving therein a support ring 72, which attaches the gate to its respective interconnecting member 35 for rotatably mounting the gate thereto and the gate is hingedly attached for stopping the movement of the gate at its closed position.

In addition to configurations featuring free swinging gates designed to align properly with the natural buildup up of sand or sediment, additional embodiments may feature several systems in which remote or programmed controlled gates may be utilized. There may be utilized systems powered by conventional energy sources such electric, localized battery or solar power. Additionally, a hydrostatic pressure system may be utilized to power the gates. Moreover, to best utilize available power sources, wave actuated energy sources which convert the change in potential due to undulating waves into electrical or mechanical energy may be utilized. Any number of gates may be controlled or left freely swinging, including any combination thereof. Individual gates or entire rows may be controlled or left to swing free in any desired combination. In a preferred embodiment, the upper most two rows of gates may be controlled.

Figure 9:
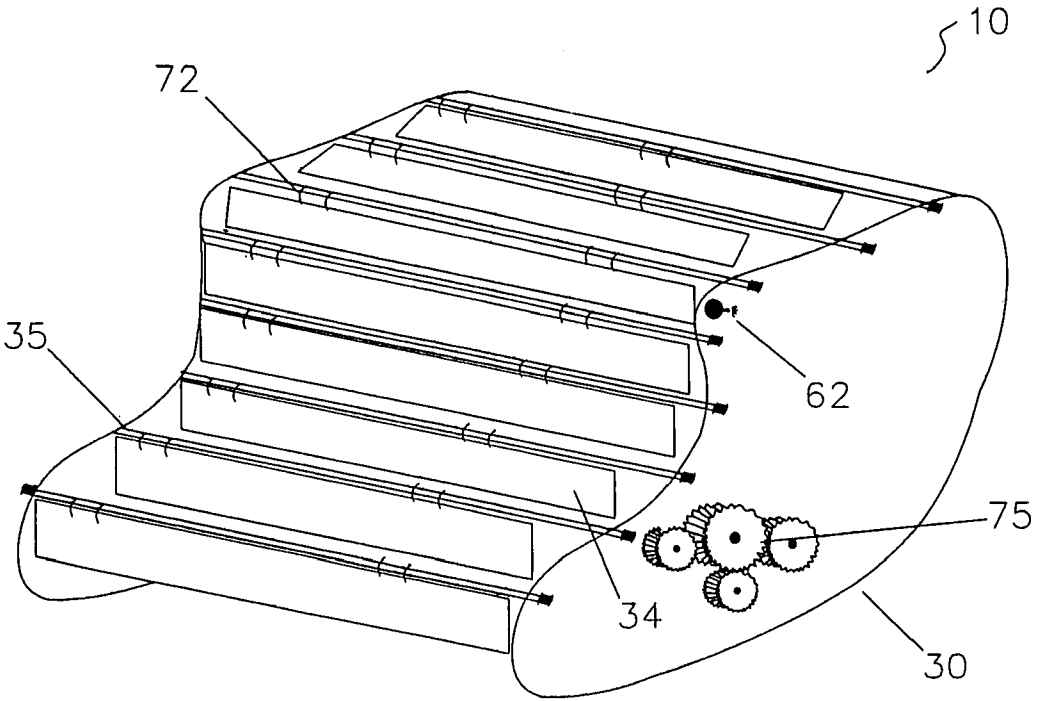
FIG. 9 is a side cutaway view of a portion of one of the walls of the main truss illustrating the gearing attached to the connecting rods.
Figure 10:
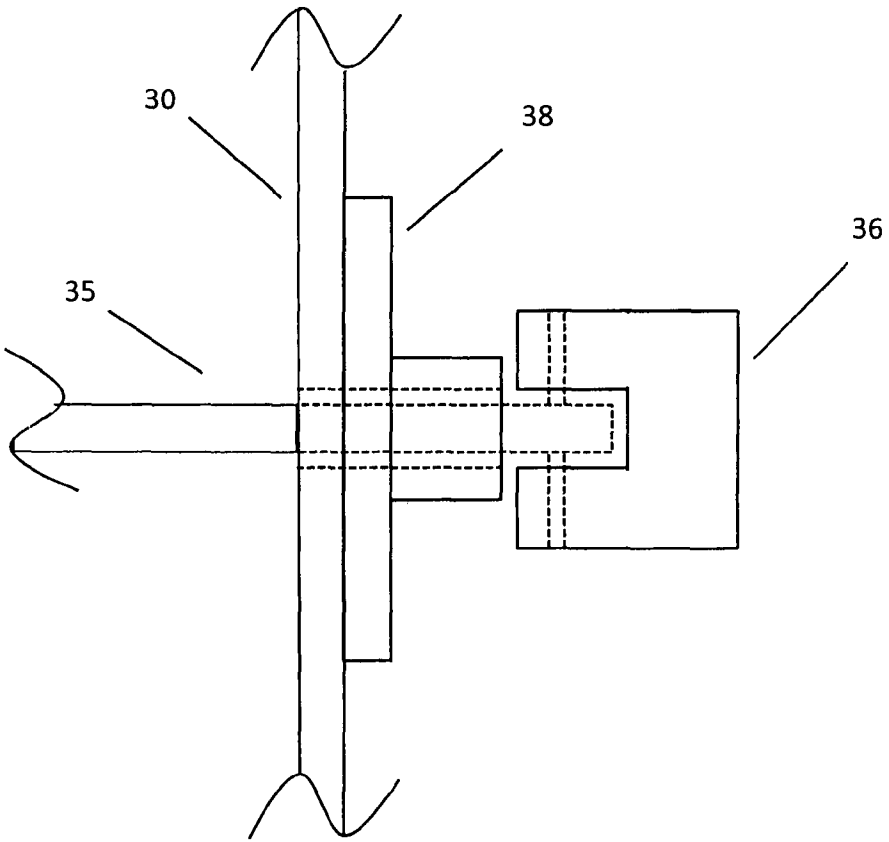
FIG. 10 illustrates a front view of the apparatus further illustrating the end cap and the circumferential flange.

Remote controlled systems may include hard wired or radio frequency systems. Servo motors or the like may be utilized through remote actuation systems. Further, in one embodiment, each row of gates may be movably attached to a connecting rod, spanning the width of the structure. The individual rods may be connected through gearing 75, a set of gears, a gear box or other such mechanism, as known in the mechanical art in order that the individual gates may be set to move differing distances. The gear box or other such apparatus should be water tight, preferably of a plastic construction or some other material, especially biodegradable or light weight material. Further, non-corrosive metals or other materials may be utilized. FIG. 9 illustrates an example of a side cutaway view of a portion of one of the walls of the main truss exhibiting the gearing attached to the connecting rods. Furthermore, sealed spacers may also be utilized for gate positioning and assistance in returning gates to the closed position Further, gears may be disposed within the connecting rods themselves and the configuration may differ within each gate so as to prove individual actuation. The individual gearing may act as a ratcheting mechanism to return the gates to the proper position upon movement caused by differential in fluid pressure. Thus, control may be individualized to each gate or may be achieved through connecting rods for each row of gates.

As stated above, the gates and system may be remotely controlled from an on shore station, in conjunction with monitoring. Further, the positioning of the gates may be programmed by all means including but not limited to conventional software programs, or machine programs and logic programs such as SLC or PLC units.

The top two rows 31 of the main truss 30 large gates 34 may be slotted in order to prevent collisions with the upper rows of the intermittent truss 50. Further, the instant invention exhibits at least one, or a plurality of, intermittent trusses 50, disposed between a singular main truss or a plurality of main trusses 30. Each of the intermittent truss constructions incorporates a plurality of smaller or miniature intermittent gates 51, which may comprise a substantially curvilinear shape convex shape and wherein the arc of which each gate faces 180 degrees from the incoming flow of water 48. The structure of the intermittent truss differs form that of the main truss in that the intermittent gates are suspended from the sediment control plates 40. Thus, the overall construction of the sub-tidal platform may evince two or more main trusses 30 and two or more intermittent trusses 50.

Additionally, the main and intermittent gates of the sub-tidal platform may be disposed to severe or separate upon application of excessive force to said main and intermittent gates. Thus, said main and intermittent gates, as well as the entirety of the structure, may be composed of biodegradable materials in the case of deconstruction. Further, the sub-tidal platform can be fabricated from light-weight, rigid thermoplastic composite material and reinforced by a resin fiber.

Thermoplastic and/or thermoset resins can be chosen from the following: acetal, acrylics, acrylonitrile-butadiene-styrene (abs), cellulosics, cellouse (organic), epoxy, fluoropolymer, melamine-formaldehyde, nylon, phenolic polyamide-imide, polyarylates, polybutylene, polycarbonate, polyethylene, polyimides, polyketones, modified polyphenylene oxide, polyphenylene sulfide, polypropylene, polystyrene, polyurethanes, polyvinyl acetate (pvac), vinyls, polyvinyl chloride, styrene acrylonitrile, sulfone polymers, thermoplastic polyester (saturated), unsaturated polyester.

Further, the reinforcement fibers may be chosen from the following: pbo fiber, date palm fibers (dpf), carbon fiber, graphite, aramids (kevlar), glass fiber, steel fibers, stainless steels. As a further ecological advance, an electrical charge sufficient to discourage the growth of marine life may be run throughout the structure.

Moreover and of high import, the instant invention exhibits advancements directed at sand particle deceleration which aid in expediting building and retention of sediment. First, the addition of scored or ribbed surfaces 60 disposed on a beach-facing, inner radial side or convex side of said plurality of main and intermittent gates serves to slow the movement of particles. Second, scoop protrusions 61, disposed on the truss walls further serve to decelerate particles and direct particle to the base of the trusses, creating initial build up. Finally, the intermittent and/or main trusses may be disposed in a saw-tooth array to further enhance particle entrapment.

Additionally, in an attempt to monitor the movement of the platform, one or more of the main trusses may contain a communications device 62 disposed substantially near the topmost surface of the main truss 30 in order to emanate signals identifying movement in all directions. The power for the communications device can be supplied by a solar ocean, tidal or wave ocean buoy, harnessed action of the gate via mechanical spring action to provide local 'in situ' power supply, or an on-shore cable feed to platform 10 array. The communications device may be in radio communication with a monitory program comprising local data collection including real-time video-surface and sub-surface-to provide constant input to a monitoring station locally, then to be transmitted or relayed to a central monitoring station. Thus, allowing the administrator of the overall system the ability to correct problems with a particular platform, to continually monitor its performance.

Additionally, each side wall 32 is identically constructed to have several cutaway openings or apertures 63 formed therein for reduction of weight and allowance of water through flow, thereby reducing the stresses caused by water force. After the sub-tidal platform 10 has been located in the desired position on the bottom 12 of the body of water 14, the platform 10 can be held in place by a plurality of sand bags (not shown), for example. More particularly, sand bags can be positioned against the side walls of the main truss in such a manner that they engage the side walls, and extend through the openings formed in the side walls to provide initial anchoring of the platform on the bottom of the body of water. Further as shown in FIG. 1, screw or driven pilings 73 attached to the base of the platform and placed into the seabed are designed to be utilized as suitable anchors.

Additional platforms 10 may then be located in the same manner in end-to-end relationship along a line essentially paralleling the beach 16, or at an angle thereto if desired, and connected together by any suitable means. In a preferred embodiment, the platforms should be arranged in arcuate arrays 70 and even disposed in a substantially s-shape 71, composed of these arcuate arrays, or any variations thereof.

Preferably, the platforms are located offshore at a distance on the order of 100 to 300 yards, depending upon specific conditions at a depth of installation that is site specific. The platforms 10 can also be anchored or secured by suitable anchors, which engage the platform 10 and are embedded in the bottom. As the above-described sand deposition occurs, the sand build-up also begins to progressively deposit against the gates 34, 51 to retain the gates in their closed position so that upon subsequent incoming water flow, the deposited sand is not washed away from inside the sub-tidal platform 10. This procedure continues upon subsequent incoming and outgoing water flow movement, with the sand continuing to build-up within the platform 10 and the area between the beach 16 and the platform 10 with the gates 34, 51 becoming progressively closed to prevent washing away of the deposited sand. This may be accomplished with renourishment of a beach with sand, the value of which is sufficient to anchor a single or even an array of STP. This process is further illustrated, in FIG. 1. As also illustrated in FIG. 1, the installation depth of any individual STP will vary with the site-specific contour and other variables.

This sand build-up then progressively continues until the top of the platform 10 has become essentially covered and anchors the once eroded beach with a volume of sand that is perchable, which in principle allows the replenishment team to point or perch the toe 74 of the sand in the direction for which sand is most needed, by orienting the STPs in certain directions and positions. Thereby reducing the volume of sand required.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A sub-tidal anti-erosion platform disposed to be submergably positioned at a beachhead comprising:

a support structure comprising a plurality of curvilinear shaped members, and at least one main truss, statically joined by a sloping sediment control plate, wherein said at least one main truss further comprises:

at least two vertically disposed side walls; and, a plurality of main gates comprising an arcuate configuration wherein the convex side of said gates are disposed away from an incoming flow of water;

at least one intermittent truss disposed between said at least one main truss and comprising a plurality of intermittent gates comprising an arcuate configuration wherein the convex side of said gates are disposed away from an incoming flow of water.

2. The sub-tidal platform of claim 1 wherein said plurality of main gates are rotatably suspended from a series of interconnecting members.

3. The sub-tidal platform of claim 1 wherein said plurality of intermittent gates are rotatably suspended from a series of sediment control plates.

4. The sub-tidal platform of claim 1 wherein said main truss side walls further comprise a series of scoop protrusions.

5. The sub-tidal platform of claim 1 wherein said at least one main truss comprises two main trusses.

6. The sub-tidal platform of claim 1 wherein said at least one intermittent truss comprises two intermittent trusses.

7. The sub-tidal platform of claim 1 wherein said platform comprises an electrical charge sufficient to discourage the growth of marine life.

8. The sub-tidal platform of claim 1 wherein said plurality of main gates possess a scored or ribbed surface disposed on a convex side of said plurality of main gates.

9. The sub-tidal platform of claim 1 wherein said plurality of intermittent gates possess a scored or ribbed surface disposed on a convex side of said plurality of main gates.

10. The sub-tidal platform of claim 1 wherein said main trusses contain a communications device disposed substantially near a top most surface disposed to monitor the movement of the at least one main truss.

11. The sub-tidal platform of claim 1 wherein said main and said intermittent gates are disposed to sever from said main and said intermittent trusses upon application of excessive force.

12. The sub-tidal platform of claim 1 wherein said plurality of intermittent gates comprises a saw tooth configuration.

13. The sub-tidal platform of claim 1 wherein said plurality of intermittent gates and said plurality of main gates are rotatably attached to connecting rods.

14. The sub-tidal platform of claim 13 wherein at least one of said plurality of intermittent gates is geared to return to an initial position upon natural disposition by fluid flow.

15. The sub-tidal platform of claim 14 wherein at least one of said plurality of main gates is geared to return to an initial position upon natural disposition by fluid flow.

16. The sub-tidal platform of claim 15 wherein said return to said initial position is controlled at each of said individual gates.

17. The sub-tidal platform of claim 15 wherein said return to said initial position is controlled by at least one of said connecting rods.

18. The sub-tidal platform of claim 15 wherein said return to said initial position is controlled by a remote control system.

19. A sub-tidal platform disposed to be placed under water at a beachhead comprising:

a main truss system comprising:

a base;

at least two vertically disposed support members;

at least two interconnecting rodlike members;

at least one large convex gate rotatably attached to said rodlike members;

at least one large slotted convex gate rotatably attached to said rodlike members;

an intermittent truss system comprising a multiplicity of small convex gates;

at least one sediment control plate affixed to said base of said main truss and disposed with a slightly sloping angle with respect to said main truss in order initiate a sand trapping effect; and, wherein said at least one sediment control plate will be supported by said intermittent truss system and wherein said intermittent truss system which is disposed between said vertically disposed support members, sized and spaced to support the sediment control plate.

20. The sub-tidal platform of claim 19 wherein said multiplicity of small convex gates and said multiplicity of large convex gates comprise a saw tooth configuration.

21. The sub-tidal platform of claim 19 wherein said sub-tidal platform is fabricated from light-weight, rigid thermoplastic composite material.

22. The sub-tidal platform of claim 21 wherein said composite material is reinforced by a thermoplastic resin fiber composite.

23. The sub-tidal platform of claim 22 wherein said thermoplastic resin is selected from the group consisting of acetal, acrylics, acrylonitrile-butadiene-styrene (abs), cellulosics, cellouse (organic), epoxy, fluoropolymer, melamine-formaldehyde, nylon, phenolic, polyamide-imide, polyarylates, polybutylene, polycarbonate, polyethylene, polyimides, polyketones, modified polyphenylene oxide, polyphenylene sulfide, polypropylene, polystyrene, polyurethanes, polyvinyl acetate (pvac), vinyls, polyvinyl chloride, styrene acrylonitrile, sulfone polymers, thermoplastic polyester (saturated) and unsaturated polyester.

24. The sub-tidal platform of claim 22 wherein said fiber is selected from the group consisting of pbo fiber, date palm fibers (dpf), carbon fiber, graphite, aramids (kevlar), glass fiber, steel fiber and stainless steel.

25. The sub-tidal platform of claim 24 wherein a communications device is installed substantially near the topmost surface of each main truss for to monitor movement of said sub-tidal platform in all directions.

26. The sub-tidal platform of claim 25 wherein power for said communications device is supplied by a source selected from the group consisting of solar ocean buoy, gate action harnessed via mechanical spring action to provide local 'in situ' power supply, and an on-shore cable feed to STP array.

27. The sub-tidal platform of claim 25 wherein said communications device is in radio communication with a monitory program comprising local data collection including real-time video-surface and sub-surface-to provide constant input to a monitoring station locally, then to be transmitted or relayed to a central monitoring station.

* * * * *